US009477171B2

(12) United States Patent
Ishii et al.

(10) Patent No.: US 9,477,171 B2
(45) Date of Patent: Oct. 25, 2016

(54) IMAGE FORMING APPARATUS THAT CONTROLS CHARGING BIAS APPLIED TO CHARGER

(71) Applicant: Brother Kogyo Kabushiki Kaisha, Nagoya-shi, Aichi-ken (JP)

(72) Inventors: Shunsuke Ishii, Nagoya (JP); Toshio Furukawa, Nagoya (JP); Hiroshige Hiramatsu, Inuyama (JP); Yuichi Matsushita, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/828,612

(22) Filed: Aug. 18, 2015

(65) Prior Publication Data

US 2016/0048091 A1 Feb. 18, 2016

(30) Foreign Application Priority Data

Aug. 18, 2014 (JP) ..... 2014-165721
Jun. 9, 2015 (JP) ..... 2015-116309

(51) Int. Cl.
*G03G 15/02* (2006.01)
*G03G 15/06* (2006.01)

(52) U.S. Cl.
CPC ..... *G03G 15/065* (2013.01); *G03G 15/0266* (2013.01)

(58) Field of Classification Search
CPC ..... G03G 15/1675; G03G 21/14
See application file for complete search history.

(56) References Cited

U.S. PATENT DOCUMENTS

2007/0048011 A1* 3/2007 Okubo ..... G03G 21/08 399/128

FOREIGN PATENT DOCUMENTS

| | | |
|---|---|---|
| JP | 2005-055741 A | 3/2005 |
| JP | 2009-048100 A | 3/2009 |
| JP | 2011-186000 A | 9/2011 |

* cited by examiner

*Primary Examiner* — Minh Phan
*Assistant Examiner* — Victor Verbitsky
(74) *Attorney, Agent, or Firm* — Banner & Witcoff, Ltd.

(57) ABSTRACT

An image forming apparatus includes a controller configured to apply a charging bias to a charger during image formation on a photoconductive body, an absolute value of the charging bias being a first absolute value. The controller applies a development bias to a development roller during the image formation, places the development roller in a development position during the image formation, after the image formation, reduces the absolute value of the charging bias to a second absolute value less than the first absolute value, after reducing the absolute value of the charging bias, separates the development roller away from the photoconductive body and places the development roller in a non-development position, and after placing the development roller in the non-development position, stops applying the development bias to the development roller.

19 Claims, 10 Drawing Sheets

IMAGE FORMING APPARATUS THAT CONTROLS CHARGING BIAS APPLIED TO CHARGER

CROSS-REFERENCE TO RELATED APPLICATION

This application claims priority under 35 U.S.C. §119 from Japanese Patent Applications No. 2014-165721 filed on Aug. 18, 2014 and No. 2015-116309 filed on Jun. 9, 2015. The entire subject matters of the applications are incorporated herein by reference.

BACKGROUND

1. Technical Field

The following description relates to one or more techniques to control a charging bias to be applied to a charger of an image forming apparatus.

2. Related Art

So far, a technique to suppress deterioration of a photoconductive body has been known. In the known technique, the photoconductive body is prevented from being deteriorated, by reducing an amount of discharge current applied to a charger for charging the photoconductive body after image formation on the photoconductive body.

SUMMARY

However, when the amount of discharge current applied to the charging member is reduced, and additionally, application of a development bias to a development roller is stopped, so-called "fog" might be caused according to a difference between a surface potential of the photoconductive body and an electric charge amount of toner on the development roller. It is noted that the "fog" is a situation where toner on the development roller is transferred onto an unexposed portion on the photoconductive body.

Aspects of the present disclosure are advantageous to provide one or more improved techniques, for an image forming apparatus, which make it possible to prevent deterioration of a photoconductive body and occurrence of "fog."

According to aspects of the present disclosure, an image forming apparatus is provided, which includes an image forming unit including a photoconductive body, a charger configured to charge the photoconductive body, and a development roller, and a controller configured to apply a charging bias to the charger during image formation on the photoconductive body, an absolute value of the charging bias being a first absolute value, apply a development bias to the development roller during the image formation on the photoconductive body, place the development roller in a development position during the image formation on the photoconductive body, after the image formation on the photoconductive body, reduce the absolute value of the charging bias to a second absolute value less than the first absolute value, after reducing the absolute value of the charging bias, separate the development roller away from the photoconductive body and place the development roller in a non-development position, the non-development position being farther from the photoconductive body than the development position, and after placing the development roller in the non-development position, stop applying the development bias to the development roller.

According to aspects of the present disclosure, further provided is a method adapted to be implemented on a processor coupled with an image forming apparatus, the image forming apparatus including an image forming unit including a photoconductive body, a charger, and a development roller, the method including applying a charging bias to the charger during image formation on the photoconductive body, an absolute value of the charging bias being a first absolute value, applying a development bias to the development roller during the image formation on the photoconductive body, placing the development roller in a development position during the image formation on the photoconductive body, after the image formation on the photoconductive body, reducing the absolute value of the charging bias to a second absolute value less than the first absolute value, after reducing the absolute value of the charging bias, separating the development roller away from the photoconductive body and placing the development roller in a non-development position, the non-development position being farther from the photoconductive body than the development position, and after placing the development roller in the non-development position, stopping applying the development bias to the development roller.

According to aspects of the present disclosure, further provided is a non-transitory computer-readable medium storing computer-readable instructions that are executable by a processor coupled with an image forming apparatus, the image forming apparatus including an image forming unit including a photoconductive body, a charger, and a development roller, the instructions being configured to, when executed by the processor, cause the processor to apply a charging bias to the charger during image formation on the photoconductive body, an absolute value of the charging bias being a first absolute value, apply a development bias to the development roller during the image formation on the photoconductive body, place the development roller in a development position during the image formation on the photoconductive body, after the image formation on the photoconductive body, reduce the absolute value of the charging bias to a second absolute value less than the first absolute value, after reducing the absolute value of the charging bias, separate the development roller away from the photoconductive body and place the development roller in a non-development position, the non-development position being farther from the photoconductive body than the development position, and after placing the development roller in the non-development position, stop applying the development bias to the development roller.

BRIEF DESCRIPTION OF THE ACCOMPANYING DRAWINGS

DETAILED DESCRIPTION

It is noted that various connections are set forth between elements in the following description. It is noted that these connections in general and, unless specified otherwise, may be direct or indirect and that this specification is not intended to be limiting in this respect. Aspects of the present disclosure may be implemented on circuits such as application specific integrated circuits or in computer software as programs storable on computer-readable media including but not limited to RAMs, ROMs, flash memories, EEPROMs, CD-media, DVD-media, temporary storage, hard disk drives, floppy drives, permanent storage, and the like.

Figure 1:
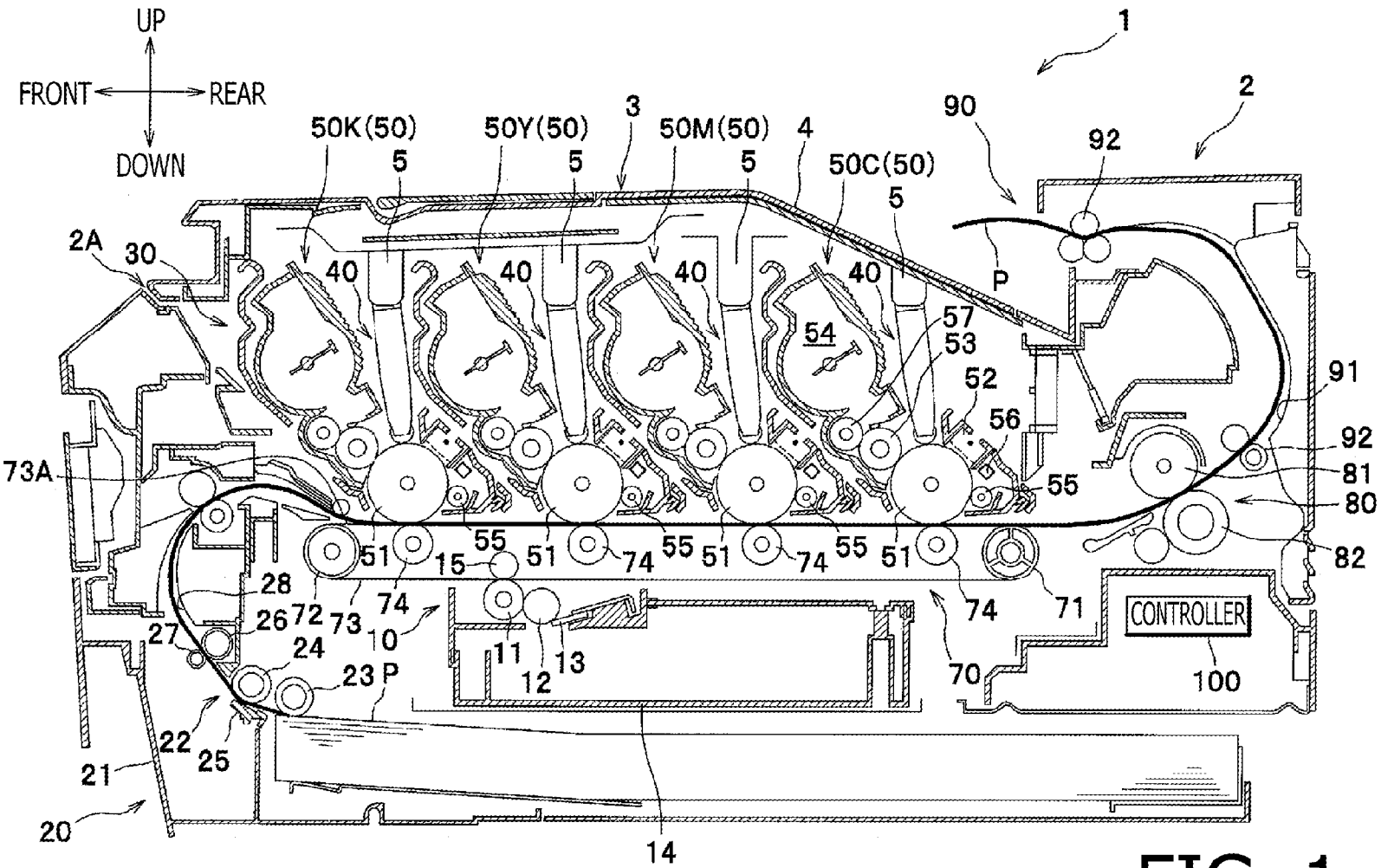
FIG. 1 is a cross-sectional side view showing a color printer in an illustrative embodiment according to one or more aspects of the present disclosure.

Hereinafter, an illustrative embodiment according to aspects of the present disclosure will be described with reference to the accompanying drawings. In the following description, each side of an apparatus (i.e., a color printer 1) will be defined as follows. In FIG. 1, a left-hand side and a right-hand side of the figure will be defined as a front side and a rear side of the apparatus, respectively. Further, a vertical direction of the figure will be defined as a vertical direction of the apparatus.

As shown in FIG. 1, the color printer 1 includes, inside a main body 2 thereof, a sheet feeder 20, an image forming unit 30, a sheet discharge unit 90, and a controller 100. The sheet feeder 20 is configured to feed sheets P. The image forming unit 30 is configured to form images on the sheets P fed from the sheet feeder 20. The sheet discharge unit 90 is configured to discharge the sheets P with the images formed thereon.

At an upper portion of the main body 2, an opening 2A is formed. The opening 2A is open and closed responsive to rotation of an upper cover 3 that is rotatably supported by the main body 2. A discharge tray 4 is disposed on an upper surface of the upper cover 3. The discharge tray 4 is configured to receive the sheets P discharged out of the main body 2. Further, on a lower surface of the upper cover 3, a plurality of LED attachment members 5 are disposed. Each LED attachment member 5 is configured to support a corresponding one of LED units 40.

The sheet feeder 20 includes a feed tray 21 and a sheet feeding mechanism 22. The feed tray 21 is disposed at a lower portion inside the main body 2. The feed tray 21 is detachably attached to the main body 2. The sheet feeding mechanism 22 is configured to convey the sheets P from the feed tray 21 to the image forming unit 30. The sheet feeding mechanism 22 is disposed in front of the feed tray 21. The sheet feeding mechanism 22 includes a pickup roller 23, a separation roller 24, and a separation pad 25.

In the sheet feeder 20, the sheets P in the feed tray 21 are conveyed upward after separated on a sheet-by-sheet basis. Then, the sheets P pass between a paper dust removing roller 26 and a pinch roller 27. In this process, paper dust is removed from the sheets P. Thereafter, the sheets P are conveyed along a conveyance path 28 and turned around rearward. Thus, the sheets P are supplied to the image forming unit 30.

The image forming unit 30 includes four LED units 40, four process cartridges 50, a transfer unit 70, a cleaning unit 10, and a fuser unit 80.

Each LED unit 40 is swingably attached to a corresponding one of the LED attachment members 5. Each LED unit 40 includes an LED array having a plurality of LEDs arranged. Each LED unit 40 is configured to expose a corresponding one of below-mentioned photoconductive drums 51 by emitting light toward the photoconductive drum 51.

The process cartridges 50 are arranged along a front-to-rear direction, between the upper cover 3 and the sheet feeder 20. Each process cartridge 50 includes a photoconductive drum 51, a charger 52, a development roller 53, a toner container 54 configured to store toner, a cleaning roller 55, and a discharge lamp 56.

The process cartridges 50 include a process cartridge 50K storing black toner, a process cartridge 50Y storing yellow toner, a process cartridge 50M storing magenta toner, and a process cartridge 50C storing cyan toner. The process cartridges 50K, 50Y, 50M, and 50C are arranged in this order from an upstream end in a conveyance direction of the sheets P. It is noted that the conveyance direction is a moving direction of a below-mentioned belt surface, i.e., a direction rearward from the front. In the present disclosure, a particular element (e.g., a photoconductive drum 51, a development roller 53, and a cleaning roller 55) corresponding to a particular color of toner is identified by a reference character provided thereto, which is a corresponding one of reference characters "K," "Y," "M," and "C" representing black, yellow, magenta, and cyan, respectively.

As described above, each of the four process cartridges 50 includes a corresponding photoconductive drum 51. As the plurality of process cartridges 50 are arranged in line along the front-to-rear direction, the plurality of photoconductive drums 51 are arranged in line along the front-to-rear direction.

As described above, each of the four process cartridges 50 includes a corresponding charger 52. The plurality of chargers 52 are provided corresponding to the plurality of photoconductive drums 51, respectively. As will be described in detail below, each charger 52 is configured to, when a charging bias Vg is applied thereto, charge the corresponding photoconductive drum 51. In the illustrative embodiment, the charger 52 is a scorotron charger having a charging wire and a grid. The charging bias Vg is applied to the grid. A surface potential of the photoconductive drum 51 corresponds to a potential of the grid. Namely, the charging bias Vg is for controlling the surface potential of the photoconductive drum 51.

As will be described in detail below, each development roller 53 is configured to contact a corresponding one of the photoconductive drums 51 and supply toner to an electrostatic latent image on the corresponding photoconductive drum 51. In the illustrative embodiment, when toner is supplied from the development roller 53 to the photoconductive drum 51, the toner is positively charged by friction between the development roller 53 and a supply roller 57.

Each cleaning roller 55 is disposed adjacent to a corresponding one of the photoconductive drums 51. Each cleaning roller 55 is configured to, when a cleaning bias Vc is applied thereto, temporarily hold (retrieve) at least a part of toner adhering onto the photoconductive drum 51. In the illustrative embodiment, in order to allow the cleaning roller 55 to temporarily hold at least a part of the toner adhering onto the photoconductive drum 51, the cleaning bias Vc needs to have a negative polarity opposite to the polarity of the toner. Thereby, the toner is more easily transferred from the positively charged photoconductive drum 51 to the cleaning roller 55.

For instance, each discharge lamp 56 includes a light source such as an LED. Each discharge lamp 56 is configured to, when turned on, emit light toward the corresponding photoconductive drum 51 and remove electric charges on the photoconductive drum 51. The discharge lamp 56 is disposed downstream of the transfer unit 70 in a rotational direction of the photoconductive drum 51. Therefore, the discharge lamp 56 removes electric charges that remain on the photoconductive drum 51 after a transferring operation to transfer a toner image on the photoconductive drum 51 onto a sheet P. Thus, the discharge lamp 56 has a function to prevent electric charges remaining on the photoconductive drum 51 from having an influence on a next electrostatic latent image or appearing on an image finally formed on a sheet P.

The transfer unit 70 is disposed between the sheet feeder 20 and each process cartridge 50. The transfer unit 70 includes a driving roller 71, a driven roller 73, and a transfer roller 74.

The driving roller 71 and the driven roller 72 are spaced apart from each other in the front-to-rear direction. An endless conveyance belt 73 is wound around the driving roller 71 and the driven roller 72. The conveyance belt 73 has a belt surface 73A that is an outer surface opposed to and in contact with the plurality of photoconductive drums 51. The conveyance belt 73 is configured to be turned by the driving roller 71 such that the belt surface 73A moves along an arrangement direction (i.e., the front-to-rear direction) of the photoconductive drums 51. Further, there are four transfer rollers 74 disposed inside a region surrounded by the conveyance belt 73. Each transfer roller 74 is opposed to a corresponding one of the photoconductive drums 51 across the conveyance belt 73. In other words, the conveyance belt 73 is pinched between each transfer roller 74 and the corresponding photoconductive drum 51. In the transferring operation, each transfer roller 74 is supplied with a transfer bias under constant current control.

The cleaning unit 10 is configured to slide in contact with the conveyance belt 73 and retrieve toner adhering onto the conveyance belt 73. The cleaning unit 10 is disposed below the conveyance belt 73. Specifically, the cleaning unit 10 includes a sliding contact roller 11, a retrieval roller 12, a blade 13, and a waste toner container 14.

The sliding contact roller 11 is disposed to contact an outer circumferential surface of the conveyance belt 73. When a retrieval bias is applied between the sliding contact roller 11 and a backup roller 15, the sliding contact roller 11 retrieves substance (e.g., toner) adhering onto the conveyance belt 73. The backup roller 15 is disposed to contact an inner circumferential surface of the conveyance belt 73 and face the sliding contact roller 11 across the conveyance belt 73.

The retrieval roller 12 is disposed to contact the sliding contact roller 11. The retrieval roller 12 is configured to retrieve substance (e.g., toner) adhering onto the sliding contact roller 11. Substance adhering onto the retrieval roller 12 is scraped by the blade 13 disposed to slide in contact with the retrieval roller 12, and is put into the waste toner container 14.

According to the cleaning roller 55, the transfer unit 70, and the cleaning unit 10, it is possible to perform cleaning control to retrieve, into the waste toner container 14, the toner temporarily held by the cleaning roller 55. In a specific procedure, firstly, when a positive cleaning bias Vc higher than the charging bias Vg is applied to the cleaning roller 55, the toner on the cleaning roller 55 is again transferred onto the photoconductive drum 51. Subsequently, for instance, when a negative transfer bias is applied to the transfer unit 70, the toner on the photoconductive drum 51 is transferred onto the conveyance belt 73. Then, as described above, the toner on the conveyance belt 73 is retrieved into the waste toner container 14 by the cleaning unit 10.

The fuser unit 80 is disposed behind the plurality of process cartridges 50 and the transfer unit 70. The fuser unit 80 includes a heating roller 81 and a pressing roller 82. The pressing roller 82 is disposed to face the heating roller 81 and configured to press the heating roller 81.

In the image forming unit 30 configured as above, firstly, when the charging bias Vg is applied to each charger 52, the surface of each photoconductive drum 51 is evenly and positively charged. Thereafter, the surface of each photoconductive drum 51 is exposed by each LED unit 40. Thereby, an electric potential of an exposed portion of the surface of each photoconductive drum 51 becomes lower, and an electrostatic latent image based on image data is formed on each photoconductive drum 51. After that, when positively-charged toner is supplied from each development roller 53 to the electrostatic latent image on each photoconductive drum 51, a toner image is carried on each photoconductive drum 51.

A sheet P fed onto the conveyance belt 73 passes between each photoconductive drum 51 and a corresponding one of the transfer rollers 74 disposed inside the region surrounded by the conveyance belt 73. Thereby, the toner image formed on each photoconductive drum 51 is transferred onto the sheet P. Then, when the sheet P passes between the heating roller 81 and the pressing roller 82, the toner transferred onto the sheet P is thermally fixed.

The sheet discharge unit 90 includes a discharge path 91 and a plurality of pairs of conveyance rollers 92. The discharge path 91 is formed to extend upward from an exit of the fuser unit 80 and be turned around frontward. The sheet P with the toner image transferred and thermally fixed thereon is conveyed along the discharge path 91 by the conveyance rollers 92, discharged out of the main body 2, and put on the discharge tray 4.

Figure 2:
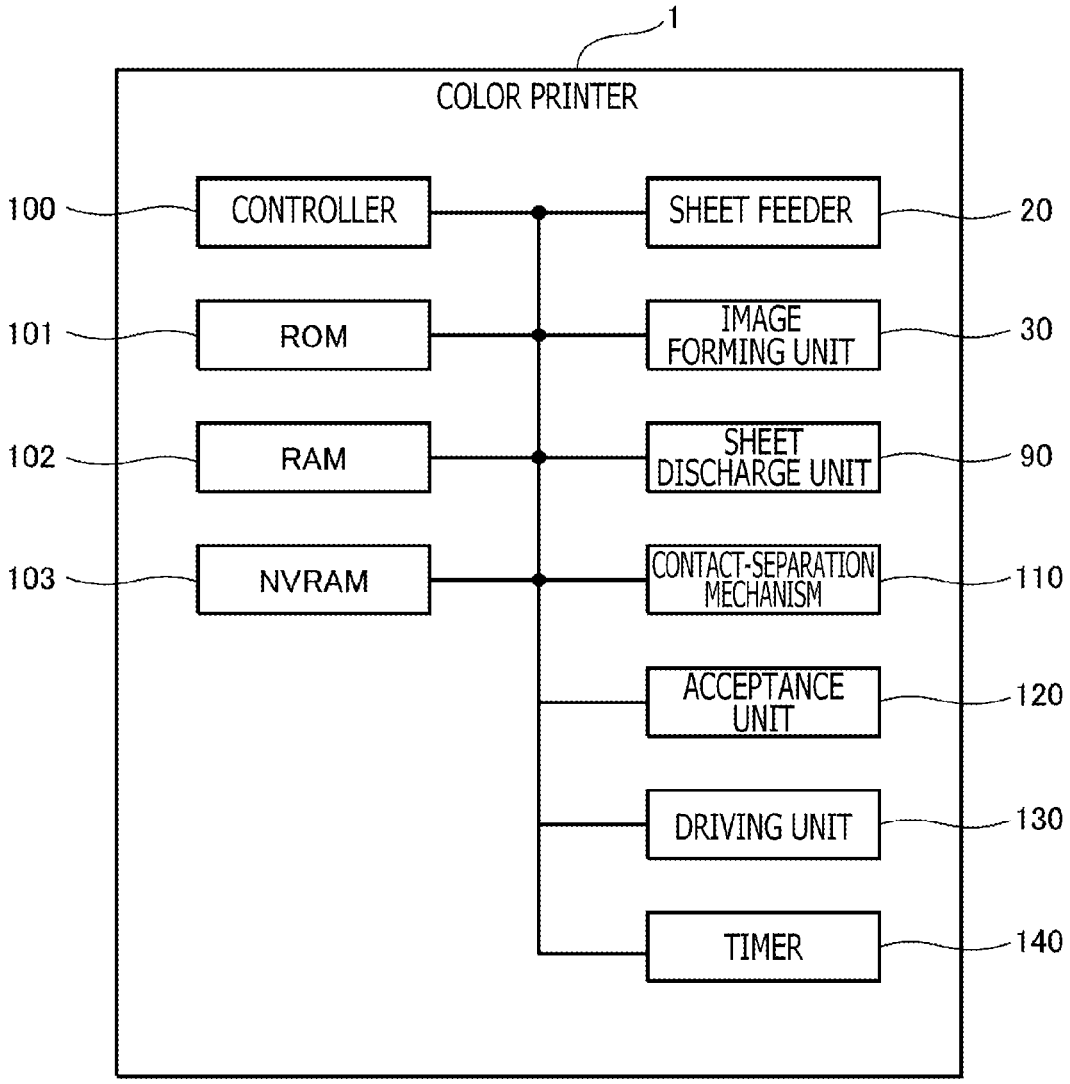
FIG. 2 is a block diagram schematically showing an electrical configuration of the color printer in the illustrative embodiment according to one or more aspects of the present disclosure.

Next, an electrical configuration of the color printer 1 will be described. As shown in FIG. 2, the color printer 1 includes the controller 100, a ROM 101, a RAM 102, and an NVRAM (which is an abbreviation form of "Non-volatile RAM") 103. Further, the color printer 1 includes the sheet feeder 20, the image forming unit 30, the sheet discharge unit 90, a contact-separation mechanism 110, an acceptance unit 120, a driving unit 130, and a timer 140. The aforementioned elements included in the color printer 1 are electrically connected with the controller 100.

The ROM 101 stores control programs, setting values, and initial values to control the color printer 1. The RAM 102 is used as a work area into which the control programs are loaded, or as a storage area for temporarily storing data. The controller 100 controls each of elements included in the color printer 1 while storing processing results into the RAM 102 or the NVRAM 103, in accordance with the control programs loaded from the ROM 101.

When controlled by the controller 100, the sheet feeder 20, the image forming unit 30, and the sheet discharge unit 90 perform image forming on the sheets P in the aforementioned manner. In particular, the chargers 52, the development rollers 53, and the cleaning rollers 55 are supplied with the charging bias Vg, a development bias Vb, and the cleaning bias Vc, respectively. In addition, the discharge lamp 56 is turned on and off under control by the controller 100.

Figure 3:
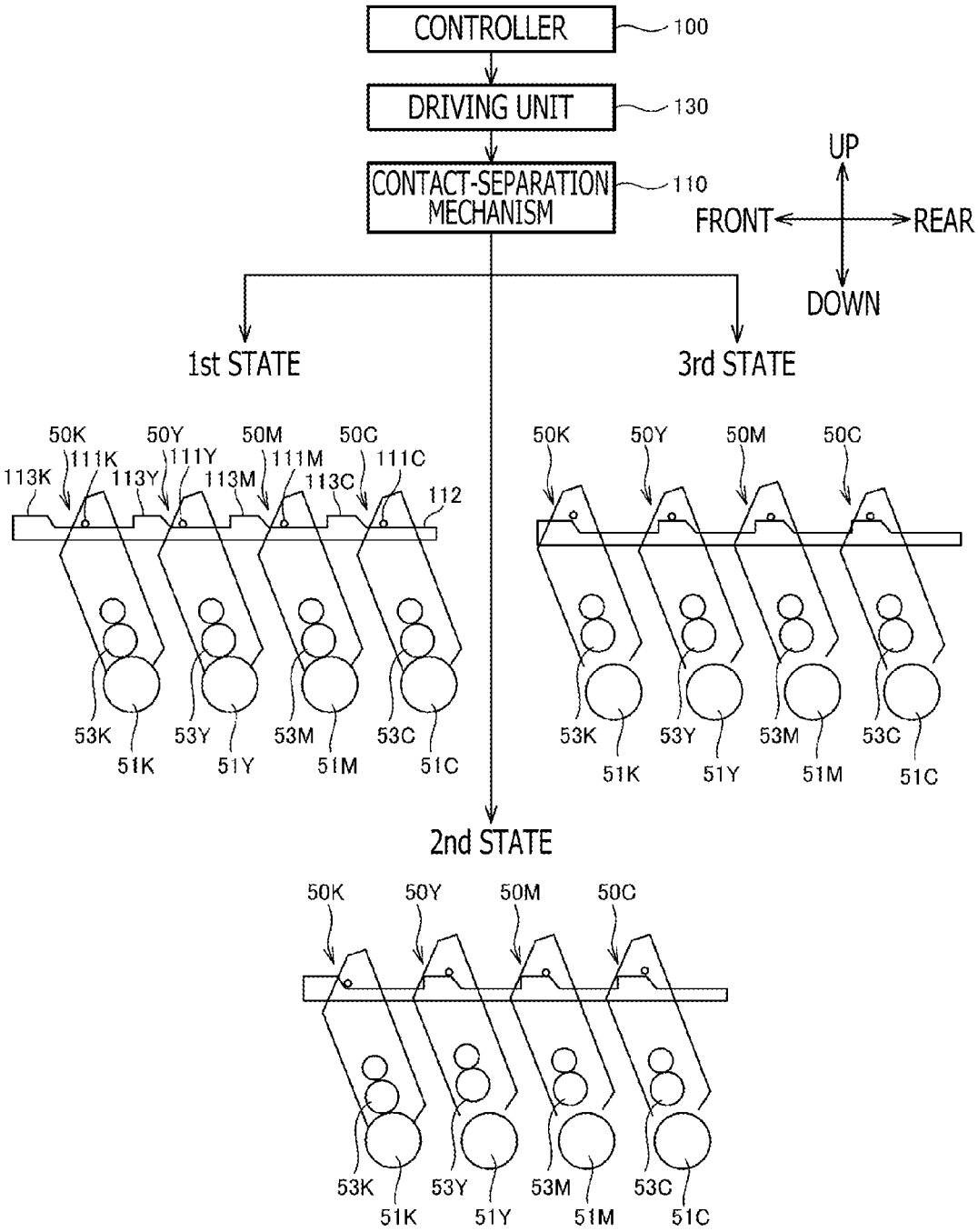
FIG. 3 illustrates a mechanism for separating development rollers away from photoconductive drums in the illustrative embodiment according to one or more aspects of the present disclosure.

Further, as shown in FIG. 3, when the contact-separation mechanism 110 is controlled by the controller 100, each development roller 53 is positioned close to or spaced apart from the corresponding photoconductive drum 51. The operations will be described in detail below.

As shown in FIG. 3, projections 111K, 111Y, 111M, and 111C are provided at upper portions of the process cartridges 50K, 50Y, 50M, and 50C, respectively. Each projection 111 is disposed substantially in the same position relative to a corresponding one of the process cartridges 50. The contact-separation mechanism 110 includes a translation cam 112. In a side view as shown in FIG. 3, the translation cam 112 extends in the front-to-rear direction across each of the process cartridges 50K, 50Y, 50M, and 50C. The translation cam 112 includes pushing-up portions 113K, 113Y, 113M, and 113C, which correspond to the projections 111K, 111Y, 111M, and 111C, respectively. In the illustrative embodiment, when each pushing-up portion 113 is positioned in front of a corresponding one of the projections 111, each development roller 53 is in a first state to contact the corresponding photoconductive drum 51. From this state, when the translation cam 112 is driven and moved rearward by the driving unit 130, each projection 111 is pushed up by the corresponding pushing-up portion 113, and each development roller 53 is also lifted up. Namely, each development roller 53 is brought into a state separated upward from the corresponding photoconductive drum 51.

Than the pushing-up portions 113Y, 113M, and 113C are positioned ahead of the projections 111Y, 111M, and 111C, respectively, the pushing-up portion 113K is positioned further ahead of the corresponding projection 111K. Namely, when the translation cam 112 is driven and moved rearward by the driving unit 130, firstly, the development rollers 53Y, 53M, and 53C are separated away from the photoconductive drums 51Y, 51M, and 51C, respectively. Subsequently, the development roller 53K is separated away from the photoconductive drum 51K.

By the contact-separation mechanism 110, the first state (e.g., for color printing) is changed to a third state (e.g., for cleaning control) via a second state (e.g., for monochrome printing). It is noted that the first state is a state where all the development rollers 53 K, 53Y, 53M, and 53C are in contact with the photoconductive drums 51K, 51Y, 51M, and 51C, respectively. In addition, the second state is a state where the development roller 53K for black (i.e., for monochrome) is only in contact with the photoconductive drum 51K, and the development rollers 53Y, 53M, and 53C for the other three colors are separated away from the photoconductive drums 51Y, 51M, and 51C, respectively. Further, the third state is a state where all the development rollers 53 K, 53Y, 53M, and 53C are separated away from the photoconductive drums 51K, 51Y, 51M, and 51C, respectively.

The acceptance unit 120 is configured to accept an image forming instruction to instruct the color printer 1 to perform image formation. For instance, the acceptance unit 120 includes hardware that communicates with devices connected with the color printer 1 via a LAN cable and/or a USB cable. Further, the acceptance unit 120 includes a liquid crystal display (hereinafter, which may be referred to as an "LCD" in an abbreviation form) and various operable members such as a start key, a stop key, and a numeric keypad. The acceptance unit 120 is configured to show various kinds of displays to a user and accept an entry of a user instruction.

The driving unit 130 is configured to, when controlled by the controller 100, transmit a driving force to the sheet feeder 20, the image forming unit 30, the sheet discharge unit 90, and the contact-separation mechanism 110. In particular, each photoconductive drum 51 is controlled to rotate or stop its rotation depending on whether the driving force from the driving unit 130 is transmitted thereto.

The timer 140 is configured to measure a time and transmit a signal corresponding to the measured time to the controller 100.

Subsequently, image formation processing by the color printer 1 will be described in detail with reference to FIGS. 4 and 5. The image formation processing includes an image forming process and cleaning control to be performed after the image forming process. It is noted that in the following description, numerical values such as bias voltage values are merely examples, and the present disclosure are not to be limited to the values.

Figure 4:
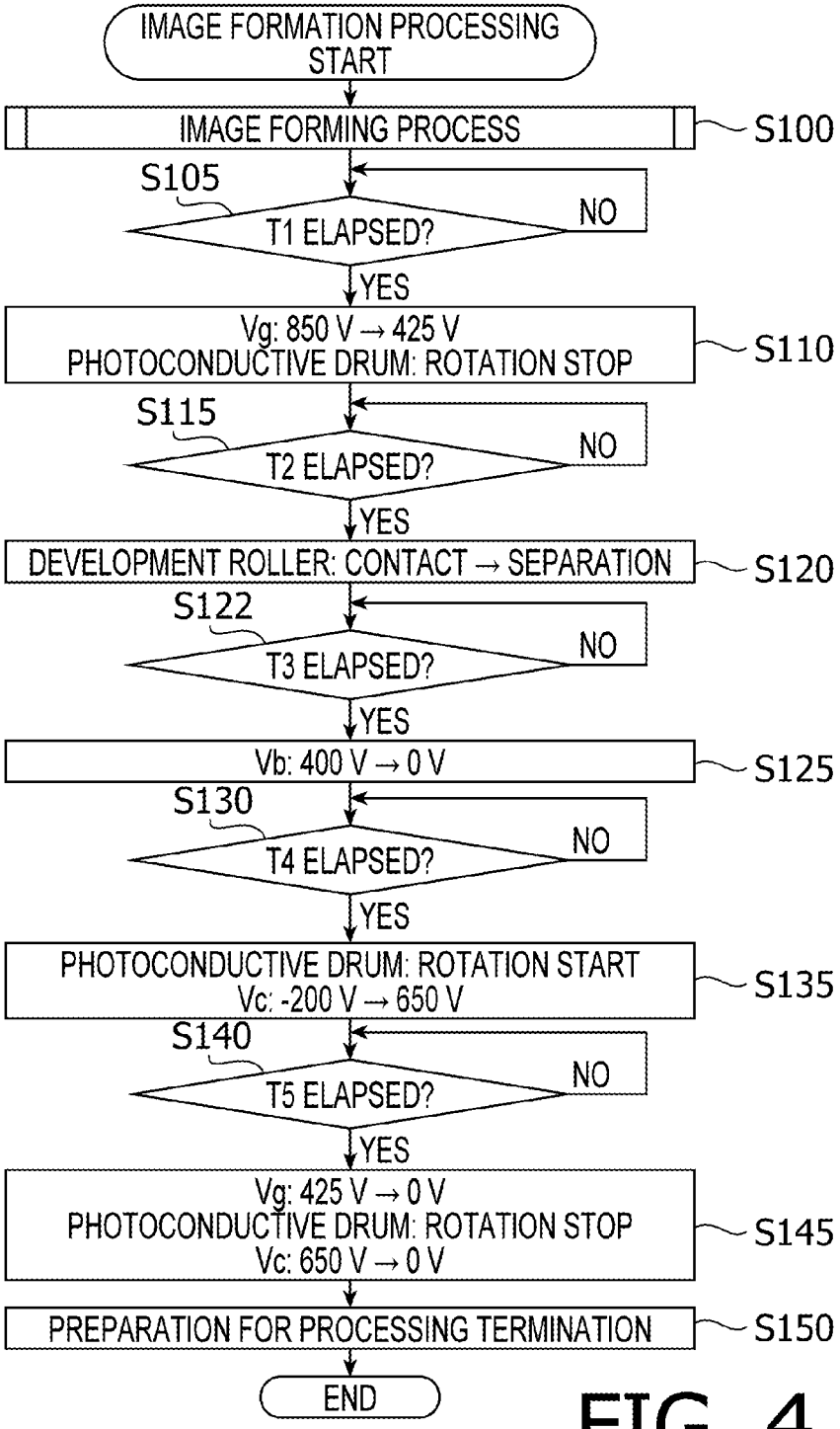
FIG. 4 is a flowchart showing a procedure of image formation processing to be executed by the color printer in the illustrative embodiment according to one or more aspects of the present disclosure.
Figure 5:
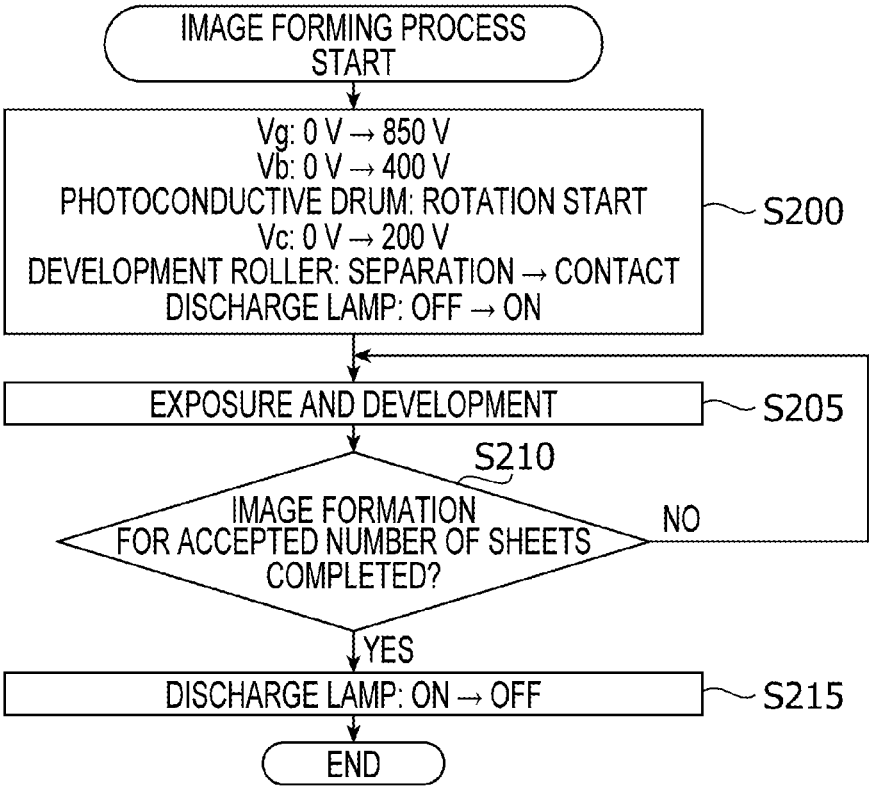
FIG. 5 is a flowchart showing a procedure of an image forming process to be executed in the image formation processing in the illustrative embodiment according to one or more aspects of the present disclosure.

For instance, when the acceptance unit 120 has accepted an image forming job, and the controller 100 determines that an image forming instruction to execute the image formation processing has been accepted, the image formation processing shown in FIGS. 4 and 5 is executed for each process cartridge 50. At the beginning of the image formation processing, neither the charging bias Vg, the development bias Vb, nor the cleaning bias Vc is applied, and each development roller 53 is spaced apart from the corresponding photoconductive drum 51. Further, the photoconductive drums 51 do not rotate. The discharge lamps 56 are turned off. Hereinafter, an explanation will be provided of the image formation processing for the process cartridge 50C as an example. The same image formation processing applies to the process cartridges 50M and 50Y. Nonetheless, the image formation processing for the process cartridge 50K will be described later with reference to a different flowchart.

In the image formation processing, the controller 100 firstly performs an image forming process (S100).

More specifically, firstly, the controller 100 applies the charging bias Vg, the development bias Vb, and the cleaning bias Vc for image formation, and starts rotating the photoconductive drum 51 (S200). It is noted that when controlling the photoconductive drum 51 to start and stop its rotation, the controller 100 controls the conveyance belt 73 to start and stop its revolution. In the illustrative embodiment, the charging bias Vg for image formation is 850 V. Further, the development bias Vb for image formation is 400 V. These are voltage values that make feasible image formation on the sheets P. Namely, in the illustrative embodiment, an absolute bias difference between the charging bias Vg and the development bias Vb is 450 V. For instance, when a predetermined bias difference is 150 V, the absolute bias difference is larger than the predetermined bias difference. The predetermined bias difference is a bias difference, between the charging bias Vg and the development bias Vb, at which it is anticipated that so-called "fog" would begin to be observed. It is noted that the "fog" is a situation where toner is transferred onto an unexposed portion other than an exposed portion on the photoconductive drum 51. Nonetheless, the predetermined bias difference is not limited to 150 V. For instance, the predetermined bias difference may be any value less than 150 V at which the fog would generally begin to be observed. In particular, the predetermined bias difference may be any value within a range from 100 V to 150 V.

Further, in S200, the controller 100 applies −200 V as the cleaning bias Vc for image formation. Toner is positively charged, e.g., via the development roller 53. Therefore, "−200 V" is a voltage value that makes it possible to electrostatically attract the toner on the photoconductive drum 51. Moreover, in S200, the controller 100 brings the development roller 53 into contact with the photoconductive drum 51. In addition, the controller 100 starts rotating the driving roller 71, the transfer rollers 74, and the sliding contact roller 11. Further, the controller 100 turns on the discharge lamp 56. Furthermore, the controller 100 begins to apply other biases required for image formation.

Subsequently, based on the accepted image forming instruction, the controller 100 performs exposure and development to form a toner image on the photoconductive drum 51 (S205). Further, in S205, the controller 100 transfers the toner image formed on the photoconductive drum 51 onto a sheet P, and conveys the sheet P to the sheet discharge unit 90. Then, after S205, the controller 100 determines whether image formation on the photoconductive drum 51 has been completed for the number of image-formed sheets indicated by the accepted image forming instruction (S210). When determining that image formation on the photoconductive drum 51 has not been completed for the number of image-formed sheets indicated by the accepted image forming instruction (S210: No), the controller 100 continuously performs image formation (S205).

Meanwhile, when determining that image formation on the photoconductive drum 51 has been completed for the number of image-formed sheets indicated by the accepted image forming instruction (S210: Yes), the controller 100 turns off the discharge lamp 56 (S215). Then, the controller 100 terminates the image forming process.

Next, the controller 100 determines whether a time T1 has elapsed after the image forming process in S100 (S105). The time T1 is a period of time between the end of the image forming process and when the controller 100 begins to reduce the charging bias Vg. The controller 100 repeatedly makes the determination in S105 until determining that the time T1 has elapsed after the image forming process (S105: No).

When determining that the time T1 has elapsed after the image forming process (S105: Yes), the controller 100 reduces the charging bias Vg to be applied to the charger 52 (S110). Further, in S110, the controller 100 stops the rotation of the photoconductive drum 51. In the illustrative embodiment, the charging bias Vg is reduced from 850 V to 425 V that is half as high as the initial value 850 V. Through S110, the absolute difference between the development bias Vb and the charging bias Vg becomes 25 V.

Subsequently, the controller 100 determines whether a time T2 has elapsed since the time T1 elapsed (S115). The time T2 is a period of time between when the charging bias Vg is reduced in S110 and when the controller 100 begins to separate the development roller 53 away from the photoconductive drum 51 (i.e., when the controller 100 begins to operate the contact-separation mechanism 110. The time T2 is set such that after the development roller 53 is completely separated away from the photoconductive drum 51, a potential difference between a surface potential V0 of the photoconductive drum 51 and a potential of a surface of the development roller 53 becomes equal to or less than a predetermined potential difference. The controller 100 repeatedly makes the determination in S115 until determining that the time T2 has elapsed since the time T1 elapsed (S115: No). In the illustrative embodiment, the surface potential V0 of the photoconductive drum 51 is converged to the same value as the charging bias Vg. In particular, when the charging bias Vg is reduced, the surface potential V0 of the photoconductive drum 51 is gradually attenuated and becomes the reduced value of the charging bias Vg. Further, the potential of the surface of the development roller 53 is identical to the development bias Vb. Thereby, in the illustrative embodiment, the time T2 is shorter than a period of time until the potential difference between the surface potential V0 of the photoconductive drum 51 and the potential of the surface of the development roller 53 becomes equal to or less than the predetermined potential difference (e.g., 150 V).

When determining that the time T2 has elapsed since the time T1 elapsed (S115: Yes), the controller 100 controls the contact-separation mechanism 110 to separate the development roller 53 away from the photoconductive drum 51 (S120). After S120, the controller 100 determines whether a time T3 has elapsed since the time T3 elapsed (S122). The time T3 is longer than a period of time between when the contact-separation mechanism 110 begins to be operated and when the development roller 53 is completely separated away from the photoconductive drum 51. The controller 100 repeatedly makes the determination in S122 until determining that the time T3 has elapsed since the time T3 elapsed (S122: No). When determining that the time T3 has elapsed since the time T3 elapsed (S122: Yes), the controller 100 stops applying the development bias Vb to the development roller 53 (S125). In other words, the controller 100 changes the development bias Vb from 400 V to 0 V.

Subsequently, the controller 100 determines whether a time T4 has elapsed after stopping the application of the development bias Vb in S125 (S130). The time T4 is a period of time until, in response to the reduction of the charging bias Vg in S110, the surface potential of the photoconductive drum 51 attenuates and stabilizes. In other words, in the illustrative embodiment, the T4 is a period of time until the surface potential of the photoconductive drum 51 attenuates to 425 V. The controller 100 repeatedly makes the determination in S130 until determining that the time T4 has elapsed (S130: No).

When determining that the time T4 has elapsed after stopping the application of the development bias Vb in S125 (S130: Yes), the controller 100 applies, to the cleaning roller 55, the cleaning bias Vc that is a positive bias having an absolute value larger than the charging bias Vg (S135). Further, in S135, the controller 100 starts rotating the photoconductive drum 51. In the illustrative embodiment, the cleaning bias Vc is changed from −200 V to 650 V. Through this operation, toner carried on the cleaning roller 55 and charged with the same polarity as the cleaning roller 55 is transferred onto the photoconductive drum 51 that has a lower potential than the cleaning roller 55. Further, the photoconductive drum 51 is rotating, and the conveyance belt 73 is revolving. In this situation, when proper biases are applied as needed to the transfer roller 74 and the cleaning unit 10, the toner on the cleaning roller 55 is retrieved into the waste toner container 14. Thus, in the illustrative embodiment, the toner on the cleaning roller 55 is transferred onto the photoconductive drum 51, by applying to the cleaning roller 55 the cleaning bias Vc that has the same polarity as the toner and the charging bias Vg and has a larger absolute value than the charging bias Vg (S135), later than S120 in which the development roller 53 is separated away from the photoconductive drum 51.

After S135, the controller 100 determines whether a time T5 has elapsed (S140). The time T5 is a period of time required to retrieve the toner on the cleaning roller 55 into the waste toner container 14. The controller 100 repeatedly makes the determination in S140 until determining that the time T5 has elapsed (S140: No).

When determining that the time T5 has elapsed (S140: Yes), the controller 100 determines that the toner on the cleaning roller 55 has substantially completely been retrieved into the waste toner container 14, and stops the application of the charging bias Vg to the charger 52, the rotation of the photoconductive drum 51, and the application of the cleaning bias Vc to the cleaning roller 55 (S145). In other words, the controller 100 changes the charging bias Vg from 425 V to 0 V, and changes the cleaning bias Vc from 650 V to 0 V. Further, the controller 100 stops application of biases to other elements (S150). Thereafter, the controller 100 terminates the image formation processing.

<Explanation of Timing Chart>

Subsequently, referring to FIG. 6, a detailed explanation will be provided of timing to make a transition from the image forming process to the cleaning control.

Figure 6:
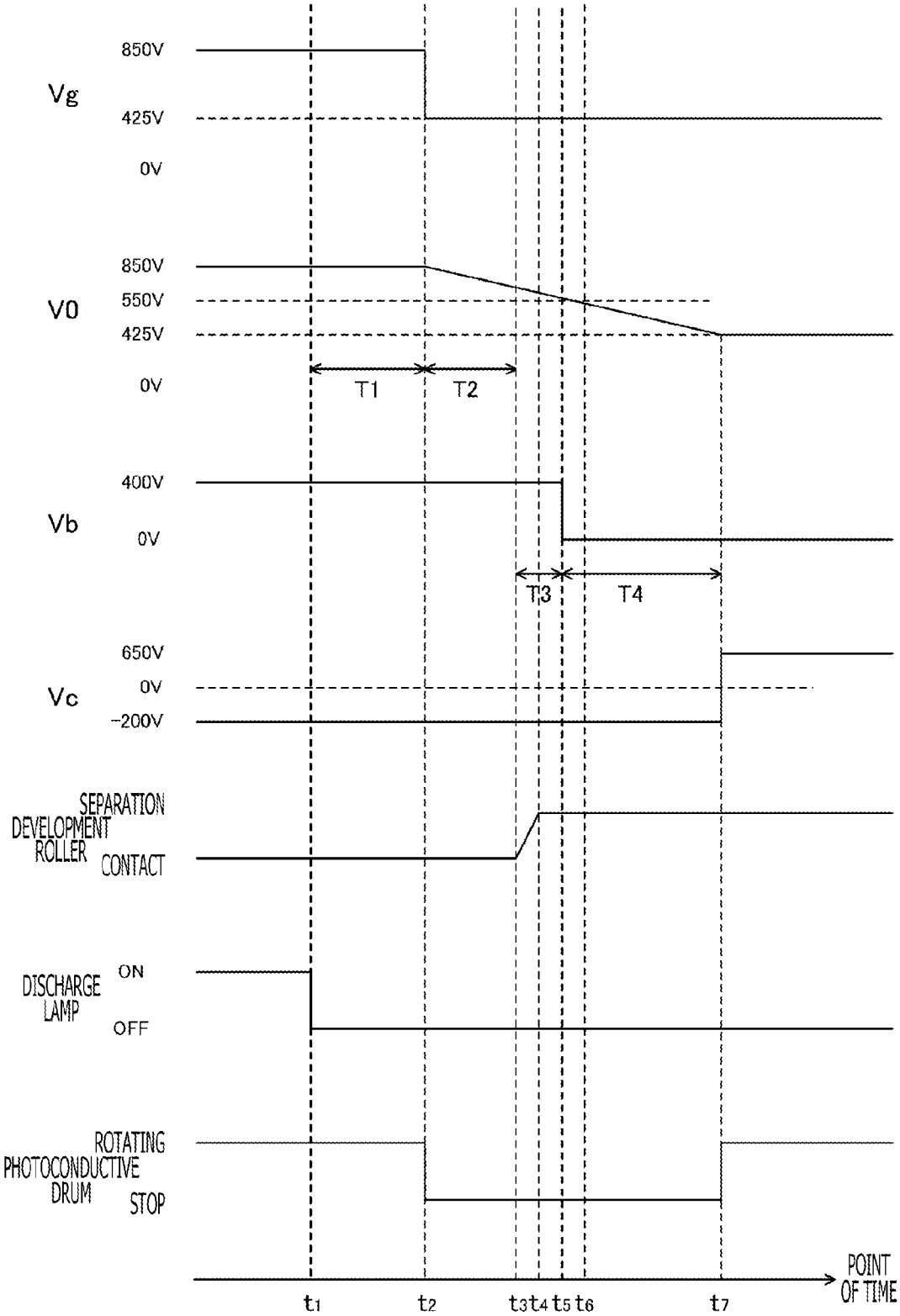
FIG. 6 is a timing chart showing timings to control elements of the color printer during a period of time between when the image forming process is completed and when cleaning control is performed, in the illustrative embodiment according to one or more aspects of the present disclosure.

As shown in FIG. 6, during the image forming process, the charging bias Vg, the development bias Vb, and the cleaning bias Vc are 850 V, 400 V, and −200 V, respectively. Further, in this state, the development roller 53 is in contact with the photoconductive drum 51, the discharge lamp 56 is turned on, and a surface potential V0 of a contact portion of the photoconductive drum 51 with the development roller 53 is 850 V. In this state, firstly, the image forming process is completed (t=t1). At the point of time t1, the discharge lamp 56 is turned off. Thereafter, the controller 100 reduces the charging bias Vg from 850 V to 425 V, and stops the rotation of the photoconductive drum 51 (t=t2). From the point of time t2 at which the charging bias Vg is reduced, the surface potential V0 of the photoconductive drum 51 is attenuated. It is noted that the value of the development bias Vb is constant during a period of time between the point of time t1 and the point of time t3. The point of time t1 is a moment at which the image forming process is completed. The point of time t3 is a moment at which the contact-separation mechanism 110 begins to be operated (controlled) to separate the development roller 53 away from the photoconductive drum 51.

After the point of time t2, at the point of time t3, the contact-separation mechanism 110 begins to be operated (controlled) to separate the development roller 53 away from the photoconductive drum 51. After t3, at the point of time t4, the operation of the contact-separation mechanism 110 is completed, and the development roller 53 is placed in a non-development position relative to the photoconductive drum 51. Further, after t4, at the point of time t5, the application of the development bias Vb is stopped. At the point of time t6 later than t4, the surface potential V0 of the photoconductive drum 51 is continuously attenuated and reduced to 550 V. Namely, the point of time t6 is a moment at which the potential difference between the surface potential V0 of the photoconductive drum 51 and the potential (400 V) of the surface of the development roller 53 at the point of time t4 becomes 150 V.

After the development roller 53 has been separated away from the photoconductive drum 51, the surface potential V0 of the photoconductive drum 51 is continuously attenuated and reduced to 550 V, at which the potential difference between the surface potential V0 of the photoconductive drum 51 and the potential (400 V) of the surface of the development roller 53 at the point of time t4 becomes 150 V (t=t6). When the potential difference between the surface potential V0 of the photoconductive drum 51 and the potential of the surface of the development roller 53 is about 150 V, and the development roller 53 is in contact with the photoconductive drum 51, the "fog" might be caused that is a situation where toner on the development roller 53 is transferred onto an unexposed portion (other than an exposed portion) on the photoconductive drum 51. However, in the illustrative embodiment, before the surface potential V0 of the photoconductive drum 51 is reduced to 550 V, the development roller 53 is separated away from the photoconductive drum 51. Thus, it is possible to prevent occurrence of the "fog."

After reduced to 550 V at the point of time t4, the surface potential V0 of the photoconductive drum 51 is further continuously attenuated and reduced to 425 V that is identical to the charging bias Vg (t=t7). The surface potential V0 of the photoconductive drum 51 is 550 V when the potential difference becomes 150 V between the surface potential V0 of the photoconductive drum 51 and the potential (400 V) of the surface of the development roller 53 that is a potential value to be maintained when the movement of the development roller 53 to the non-development position is not completed. At the point of time t7, the cleaning bias Vc is controlled and changed from −200 V to 650 V. Additionally, at the point of time t7, the photoconductive drum 51 begins to be rotated. Further, at the point of time t7, the aforementioned cleaning control is performed, and the image formation processing is terminated.

According to the illustrative embodiment, firstly, the charging bias Vg is reduced (t=t2, S110). Thereby, it is possible to prevent deterioration of the photoconductive drum 51. Further, the development roller 53 is separated away from the photoconductive drum 51 (t=t4, S120), and thereafter the application of the development bias Vb is stopped (t=t5, S125). Therefore, it is possible to prevent the potential difference between the surface potential V0 of the photoconductive drum 51 (that is gradually attenuated in response to the reduction of the charging bias Vg) and the potential of the surface of the development roller 53 from increasing at a development position. Thus, it is possible to avoid occurrence of the "fog."

Further, by execution of S135 at the point of time t7, it is possible to transfer, onto the photoconductive drum 51, the tonner electrostatically attracted onto the development roller 53.

Further, the charging bias Vg in the aforementioned toner transferring from the development roller 53 onto the photoconductive drum 51 is 425 V resulting from the reduction of the charging bias Vg in S110. Therefore, there is no need to adjust the charging bias Vg so as to transfer onto the photoconductive drum 51 the tonner electrostatically attracted onto the development roller 53.

Further, in S110 at the point of time t2, the rotation of the photoconductive drum 51 is stopped. Therefore, it is possible to prevent deterioration of the photoconductive drum 51.

Further, the discharge lamp 56 is turned off (t=t1, S215) after completion of the image forming process (t=t1, S210: Yes) and before the reduction of the charging bias Vg (t=t2, S110). Therefore, it becomes more likely that the surface potential of the photoconductive drum 51 is gradually attenuated. Thereby, it is more certainly possible to set earlier the point of time t2 at which the charging bias Vg is reduced in S110. Thus, it is possible to more effectively prevent deterioration of the photoconductive drum 51. In addition, it is possible to prevent the discharge lamp 56 from being unnecessarily turned on.

Further, the development roller 53 is in contact with the photoconductive drum 51 until the point of time t3 at which S120 is executed. There is a possibility that the "fog" might be caused not only when the development roller 53 is in proximity to the photoconductive drum 51 but also when the development roller 53 is in physical contact with the photoconductive drum 51. In this case, since the development roller 53 is separated away from the photoconductive drum 51, it is possible to avoid the physical contact therebetween. Thus, it is possible to more certainly prevent occurrence of the "fog."

Figure 7:
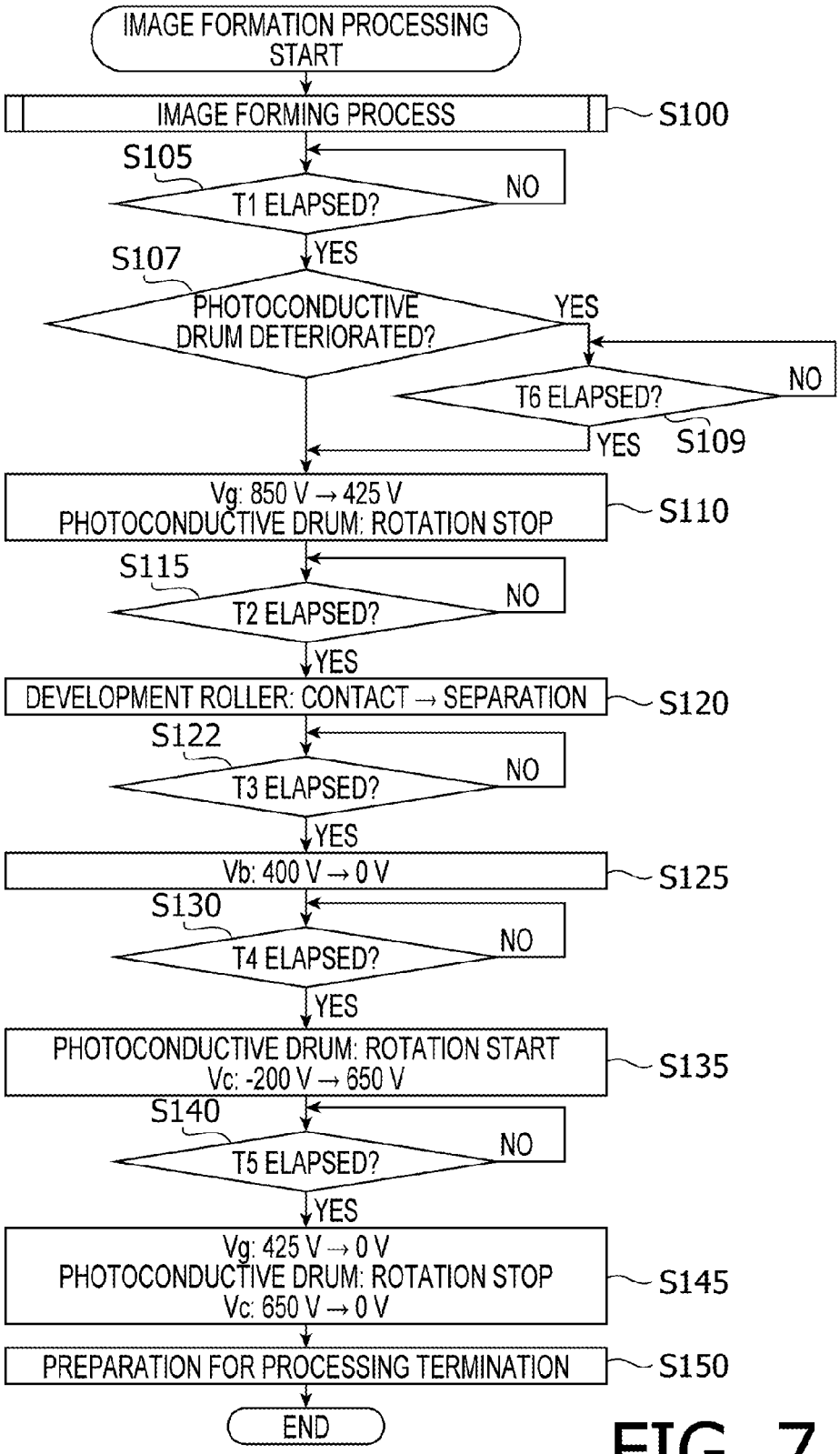
FIG. 7 is a flowchart (different from FIG. 4) showing a procedure of image formation processing to be executed by the color printer in the illustrative embodiment according to one or more aspects of the present disclosure.

Subsequently, a detailed explanation will be provided of another example of image formation processing to be executed by the color printer 1, with reference to FIG. 7 showing a flowchart different from FIG. 4.

In the flowchart shown in FIG. 7, S107 is added between S105 and S110 of the flowchart shown in FIG. 4. It is noted that in S105, the controller 100 determines whether the time T1 has elapsed after the image forming process in S100. Further, in S110, the controller 100 reduces the charging bias Vg to be applied to the charger 52.

In S107, the controller 100 determines whether the photoconductive drum 51 is deteriorated, by determining whether an accumulated number of sheets image-formed during a period of time between when the photoconductive drum 51 was new and the present is equal to or more than a predetermined number of sheets. It is noted that the accumulated number of image-formed sheets is stored in the NVRAM 103, and is reset each time the photoconductive drum 51 is replaced with a new one. In addition, the accumulated number of image-formed sheets is incremented each time image formation is performed.

When determining that the accumulated number of image-formed sheets is less than the predetermined number of sheets (S107: No), the controller 100 determines that the photoconductive drum 51 is not deteriorated, and goes to S110.

Meanwhile, when determining that the accumulated number of image-formed sheets is equal to or more than the predetermined number of sheets (S107: Yes), the controller 100 determines that the photoconductive drum 51 is deteriorated, and goes to S109. In S109, the controller 100 determines whether a time T6 has elapsed since the time T1 elapsed. The time T6 is a period of time for which the controller 100 is to wait so as to delay a point of time to reduce the charging bias Vg in consideration that the surface potential V0 of the photoconductive drum 51 might be promptly attenuated due to the deterioration of the photoconductive drum 51. The controller 100 repeatedly makes the determination in S109 until determining that the time T6 has elapsed since the time T1 elapsed (S109: No).

When determining that the time T6 has elapsed since the time T1 elapsed (S109: Yes), the controller 100 goes to S110 to reduce the charging bias Vg.

Figure 8:
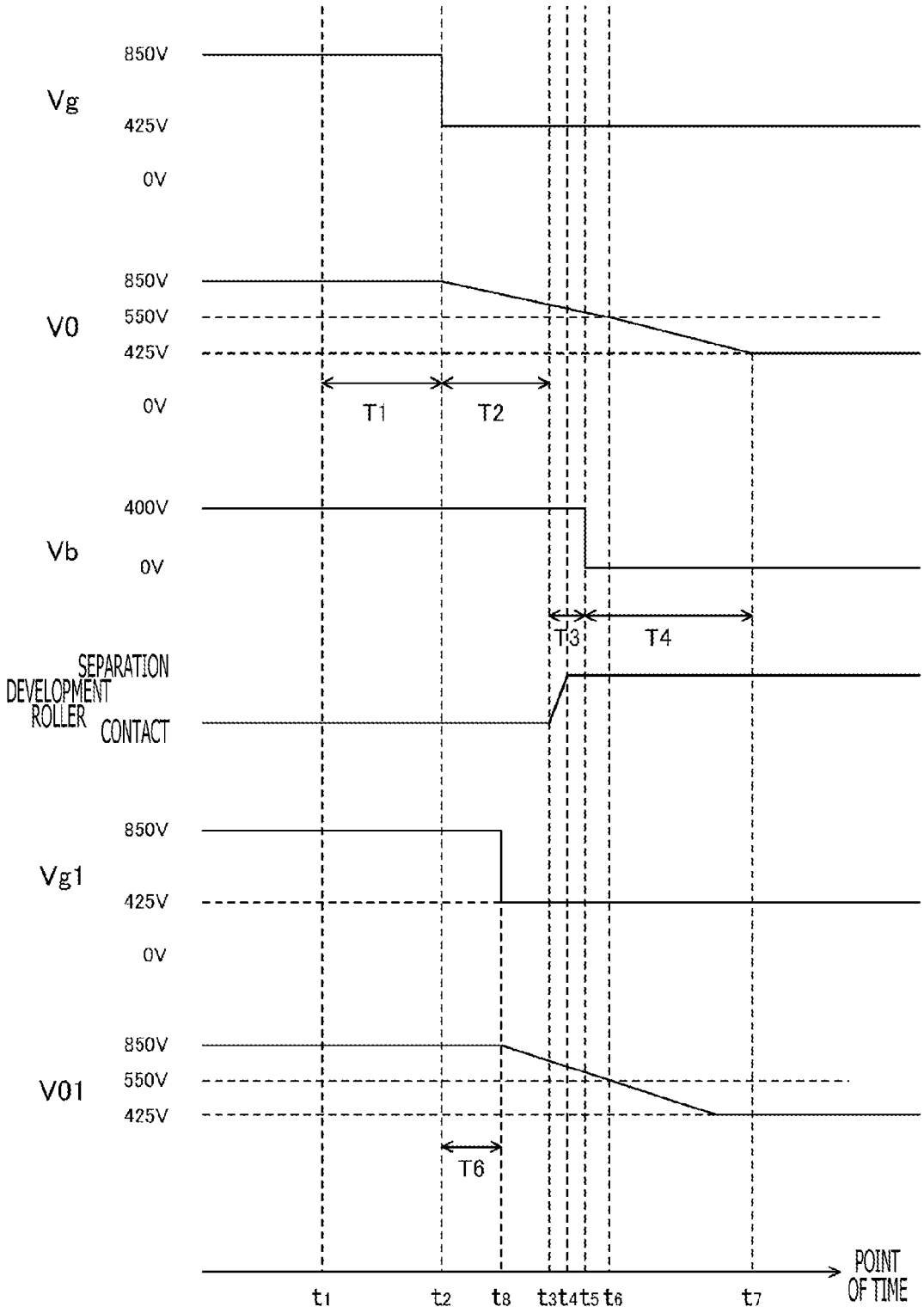
FIG. 8 is a timing chart (different from FIG. 6) showing timings to control elements of the color printer during the period of time between when the image forming process is completed and when the cleaning control is performed, in the illustrative embodiment according to one or more aspects of the present disclosure.

Subsequently, referring to FIG. 8, a detailed explanation will be provided of timing to make a transition from the image forming process to the cleaning control in the flowchart shown in FIG. 7.

Hereinafter, in this example, a "charging bias Vg" and a "surface potential V0" will represent a charging bias to be applied to the charger 52 and a surface potential of the photoconductive drum 51 when it is determined that the photoconductive drum 51 is not deteriorated, respectively. Meanwhile, a "charging bias Vg1" and a "surface potential V01" will represent a charging bias to be applied to the charger 52 and a surface potential of the photoconductive drum 51 when it is determined that the photoconductive drum 51 is deteriorated, respectively.

The controller 100 reduces the charging bias Vg at the point of time t2. Meanwhile, the controller 100 reduces the charging bias Vg1 at a point of time t8 later than the point of time t2. This is because as shown in FIG. 8, the surface potential V01 of the photoconductive drum 51 is attenuated more promptly than the surface potential V0. Namely, when determining in S107 that the photoconductive drum 51 is deteriorated, the controller 100 shortens a period of time between a point of time (t8) at which the charging bias Vg1 is reduced and a point of time (t3) at which the development roller 53 begins to be separated away from the photoconductive drum 51.

Thereafter, regardless of whether the photoconductive drum 51 is deteriorated, the contact-separation mechanism 110 begins to be operated (controlled) to separate the development roller 53 away from the photoconductive drum 51 at the point of time t3. After that, for instance, the surface potential V01 of the photoconductive drum 51 is attenuated to 550 V at the point of time t6, which is the same point of time as when the surface potential V0 of the photoconductive drum 51 is attenuated to 550 V.

According to the illustrative embodiment, the controller 100 reduces the charging bias Vg1 and separates the development roller 53 away from the photoconductive drum 51 at respective proper timings, in consideration of that the surface potential V01 of the photoconductive drum 51 is promptly attenuated due to the deterioration of the photoconductive drum 51. Thereby, it is possible to more effectively prevent the photoconductive drum 51 from being further deteriorated, and to prevent the "fog."

In particular, the point of time to reduce the charging bias Vg1 is set to the point of time t8 that is later than the point of time t2 at which the charging bias Vg is reduced when it is determined that the photoconductive drum 51 is not deteriorated. Namely, the period of time between the completion of the image forming process and the point of time (t8) at which the charging bias Vg1 is reduced is set longer than the period of time between the completion of the image forming process and the point of time (t2) at which the charging bias Vg is reduced. Thereby, without having to change the timing (t3, S120) to begin to separate the development roller 53 away from the photoconductive drum 51, it is possible to shorten the period of time between when the charging bias Vg1 is reduced and when the development roller 53 begins to be separated away from the photoconductive drum 51.

Figure 9:
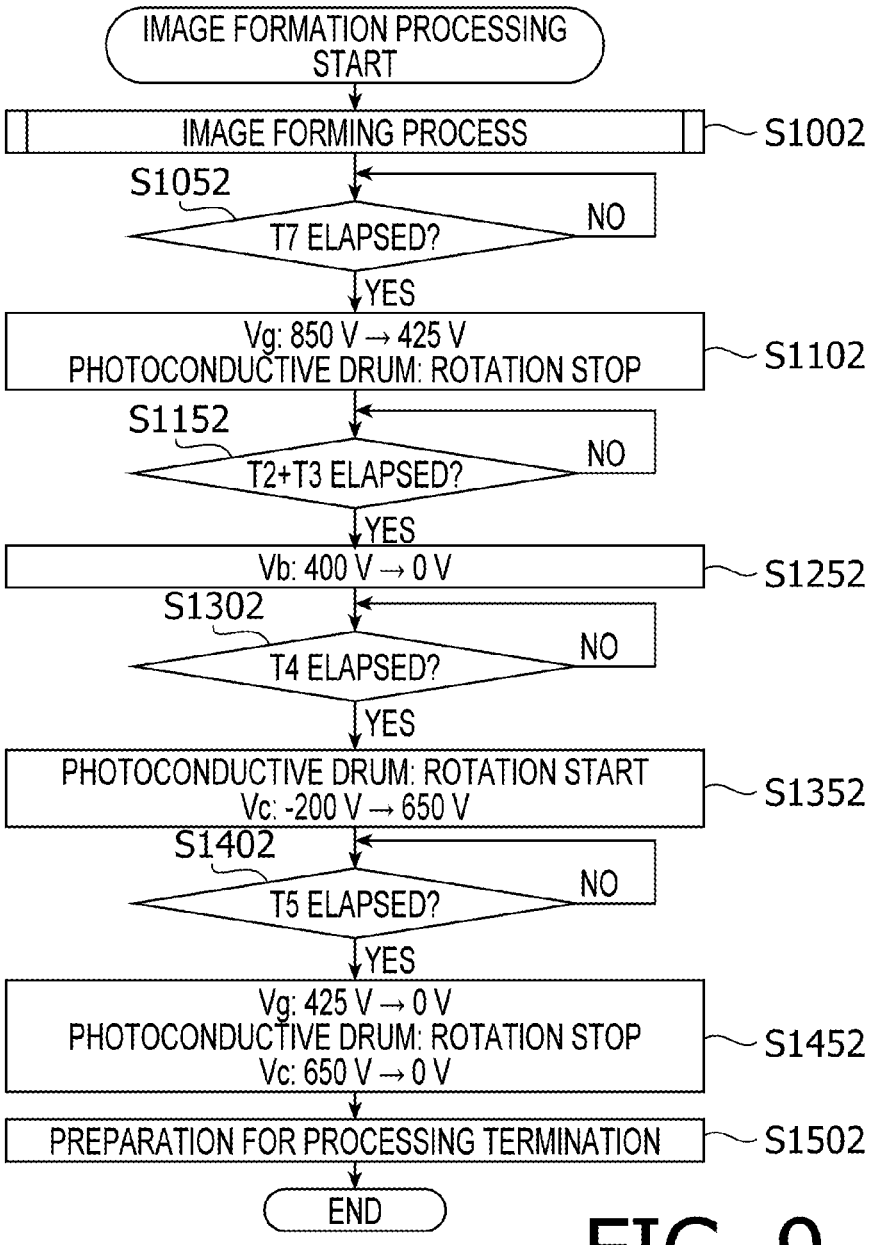
FIG. 9 is a flowchart (different from FIGS. 4 and 7) showing a procedure of image formation processing to be executed by the color printer in the illustrative embodiment according to one or more aspects of the present disclosure.

Subsequently, a detailed explanation will be provided of another example of image formation processing to be executed by the color printer 1, with reference to FIG. 9 showing a flowchart different from FIGS. 4 and 7.

The image formation processing shown in FIG. 9 is executed for the process cartridge 50K. For the process cartridges 50Y, 50M, and 50C other than the process cartridge 50K, the image formation processing shown in FIG. 4 is executed in parallel. In the flowchart shown in FIG. 9, S1052 is a step corresponding to S105 in FIG. 4. Nonetheless, in S1052, the controller 100 determines whether a time T7, instead of the time T1 in S105, has elapsed after an image forming process. Moreover, the flowchart shown in FIG. 9 does not include a step corresponding to S120 in FIG. 4 to separate the development roller 53 away from the photoconductive drum 51.

After the image forming process has been completed in S1002 for each of the photoconductive drums 51 corresponding to the process cartridges 50C, 50M, 50Y, and 50K, in S1052, the controller 100 determines whether the time T7 has elapsed after the image forming process. The time T7 is a period of time for which the controller 100 is to wait so as to delay a point of time to reduce the charging bias Vg in consideration of that as described above, among all the development rollers 53K, 53Y, 53M, and 53C, only the development roller 53K begins to be separated away from the corresponding photoconductive drum 51K later than the other development rollers 53Y, 53M, and 53C. Namely, the time T7 is longer than the time T1. The controller 100 repeatedly makes the determination in S1052 until determining that the time T7 has elapsed after the image forming process (S1052: No).

When determining that the time T7 has elapsed after the image forming process (S1052: Yes), the controller 100 goes to S1102 and reduces a charging bias Vgk to be applied to the charger 52K in the same manner as executed in S110.

After S1102, when determining that a sum of the times T2 and T3 has elapsed after a lapse of the time T7 (S1152: Yes), the controller 100 reduces the development bias Vb (S1252). Since the image formation processing shown in FIG. 4 is performed in parallel, when the sum of the times T2 and T3 has elapsed after a lapse of the time T7 (S1152: Yes), the development roller 53K is placed in the non-development position.

Figure 10:
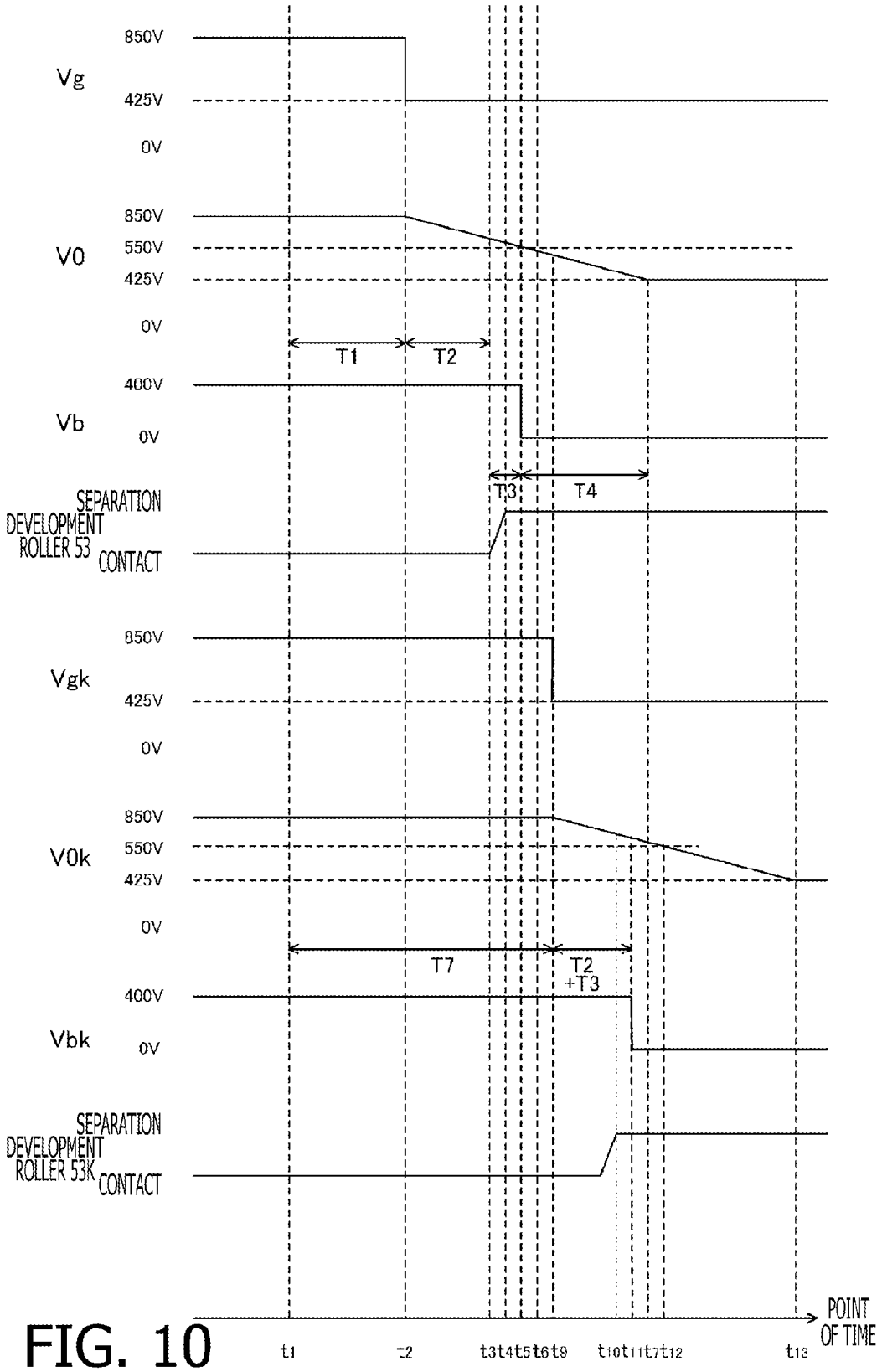
FIG. 10 is a timing chart (different from FIGS. 6 and 8) showing timings to control elements of the color printer during the period of time between when the image forming process is completed and when the cleaning control is performed, in the illustrative embodiment according to one or more aspects of the present disclosure.

Subsequently, referring to FIG. 10, a detailed explanation will be provided of timing to make a transition from the image forming process to the cleaning control.

Hereinafter, a surface potential V0 will represent a surface potential of each of the photoconductive drums 51Y, 51M, and 51C other than the photoconductive drum 51K. Further, a surface potential V0*k* will represent a surface potential of the photoconductive drum 51K.

The charging bias Vgk is reduced at a point of time t9. It is noted that the point of time t9 is a moment after a lapse of the time T7 from the point of time t1 at which the image forming process is completed. Further, as described above, the time T7 is a period of time longer than the time T1. This is because, as shown in FIG. 10, a point of time (t10) at which the development roller 53K is completely moved to the non-development position is later than a point of time (t4) at which the other development rollers 53Y, 53M, and 53C are completely moved to the respective non-development positions.

Thereafter, the development bias Vbk is reduced at a point of time t11 that is a moment after a lapse of the sum of the times T2 and T3 from the point of time t9. The surface potential V0*k* of the photoconductive drum 51*k* is attenuated to 550 V at a point of time t12, and further attenuated to 425 V at a point of time t13.

According to the illustrative embodiment, each charging bias Vg is reduced at the points of time (t2 and t9), which is a timing determined depending on the length of the period of time (t1 to t7, and t1 to t13) during which the surface potential of the corresponding photoconductive drum 51 is allowed to be attenuated, before the corresponding development roller 53 is separated away from the photoconductive drum 51. Thereby, it is possible to prevent deterioration of the photoconductive drums 51 and avoid occurrence of the "fog."

Hereinabove, the illustrative embodiment according to aspects of the present disclosure has been described. The present disclosure can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present disclosure. However, it should be recognized that the present disclosure can be practiced without reapportioning to the details specifically set forth. In other instances, well known processing structures have not been described in detail, in order not to unnecessarily obscure the present disclosure.

Only an exemplary illustrative embodiment of the present disclosure and but a few examples of their versatility are shown and described in the present disclosure. It is to be understood that the present disclosure is capable of use in various other combinations and environments and is capable of changes or modifications within the scope of the inventive concept as expressed herein. For instance, according to aspects of the present disclosure, the following modifications are possible.

MODIFICATION

In the aforementioned illustrative embodiment, the controller 100 performs all of the control operations. Nonetheless, the control operations may be performed by a plurality of controllers. Further, the processes and operations disclosed in the illustrative embodiment may be achieved by various aspects such as a storage medium storing computer-executable instructions to perform the processes and operations and methods for performing the processes and operations.

In the aforementioned illustrative embodiment, aspects of the present disclosure are applied to the color printer 1. Nonetheless, aspects of the present disclosure may be applied to other image forming apparatuses such as copy machines and multi-function peripherals.

In the aforementioned illustrative embodiment, the color printer 1 is an image forming apparatus configured to perform an exposure operation in an LED array method. Nonetheless, the color printer 1 may be an image forming apparatus configured to perform an exposure operation in a laser scanning method.

In the aforementioned illustrative embodiment, the color printer 1 is configured to positively charge toner and perform the image forming process and the cleaning control. Nonetheless, the color printer 1 may be configured to negatively charge toner. In this case, the polarity of each bias may be inverted.

In the aforementioned illustrative embodiment, during the image forming process in S100, the development rollers 53 are placed in contact with the corresponding photoconductive drums 51, respectively. Nonetheless, the development rollers 53 may not necessarily be placed in contact with the photoconductive drums 51. The development rollers 53 may be placed in proximity to the photoconductive drums 51. In this case, after the image forming process, the development rollers 53 may be separated farther away from the photoconductive drums 51 than during the image forming process.

According to the aforementioned illustrative embodiment, in the operation, to be started with the cleaning bias Vc set to 650 V in S135, of transferring the toner on the cleaning roller 55 onto the photoconductive drum 51, the charging bias Vg is 425 V to which the charging bias Vg is reduced from 850 V in S110. However, the value of the charging bias Vg reduced in S110 may not necessarily be identical to the value of the charging bias Vg in the operation of transferring the toner on the cleaning roller 55 onto the photoconductive drum 51. For instance, instead, the charging bias Vg may be adjusted to an appropriate value (e.g., 425 V) after the development roller 53 is separated away from the photoconductive drum 51 in S120. Nonetheless, when the value of the charging bias Vg reduced in S110 is identical to the value of the charging bias Vg in the operation of transferring the toner on the cleaning roller 55 onto the photoconductive drum 51, it provides such an advantageous effect that there is no need to later adjust the charging bias Vg to an appropriate value (e.g., 425 V) for the operation of transferring the toner on the cleaning roller 55 onto the photoconductive drum 51.

In the aforementioned illustrative embodiment, the color printer 1 includes the discharge lamps 56 configured to emit light toward the photoconductive drums 51 and remove electric charges on the photoconductive drums 51. Nonetheless, instead, the electric charges on the photoconductive drums 51 may be removed by other methods such as supplying electric charges onto the photoconductive drums 51.

In the aforementioned illustrative embodiment, the image forming process for each process cartridge 50 is completed at the same point of time t1. Further, the development rollers 53Y, 53M, and 53C are completely moved to their respective non-development positions at the point of time t4, while the development roller 53K is completely moved to its non-development position at the point of time t10 later than t4. In these situations, the charging biases Vg to be applied to the chargers 52Y, 52M, and 52C are reduced to be equal to or less than 550 V at the point of time t2. Further, the charging bias Vg to be applied to the charger 52K is reduced to be equal to or less than 550 V at the point of time t9 later than t2. Thereby, each development roller 53 is separated away from the corresponding photoconductive drum 51 before the surface potential of the photoconductive drum 51 becomes equal to or less than 550 V. Nonetheless, for example, the following modification is possible. Suppose, for instance, that the image forming processes for the process cartridges 50 are completed at different timings depending on whether each individual process cartridge 50 is positioned upstream or downstream of the sheet P in the conveyance direction, and that each development roller 53 is separated away from the corresponding photoconductive drum 51 at the same point of time. In such situations, by reducing the charging biases Vg for the chargers 52K, 52Y, 52M, and 52C to be equal to or less than 550 V at different timings, each development roller 53 may be separated away from the corresponding photoconductive drum 51 before the surface potential of the photoconductive drum 51 becomes equal to or less than 550 V.

In the aforementioned illustrative embodiment, the value of the development bias Vb is constant during the period of time between the point of time t1 at which the image forming process is completed and the point of time t5 at which the application of the development bias Vb is stopped. Nonetheless, for instance, at the point of time t2 at which the charging bias Vg is reduced, the development bias Vb may be reduced to a predetermined value or may be gradually reduced.

In the aforementioned illustrative embodiment, the controller 100 reduces the charging bias Vg (S110), and thereafter begins to control the contact-separation mechanism 110 to separate the development roller 53 away from the photoconductive drum 51 (S120). Nonetheless, as long as the development roller 53 is completely moved to the non-development position after the reduction of the charging bias Vg, the controller 100 may begin to control the contact-separation mechanism 110 to separate the development roller 53 away from the photoconductive drum 51 before reducing the charging bias Vg.

In the aforementioned illustrative embodiment, the controller 100 reduces the charging bias Vg (S110) and completes the movement of the development roller 53 to the non-development position (S122: Yes), and thereafter stops the rotation of the photoconductive drum 51 (S145). Nonetheless, for instance, the controller 100 may stop the rotation of the photoconductive drum 51 after reducing the charging bias Vg (S110) and before completing the movement of the development roller 53 to the non-development position.

In the aforementioned illustrative embodiment, the controller 100 stops applying the development bias Vb to the development roller 53 in S125 before executing S135 and S145. Nonetheless, the controller 100 may stop applying the development bias Vb to the development roller 53 after executing S135 or S145.

In the aforementioned illustrative embodiment, a scorotron charger is employed as the charger 52. Nonetheless, a corotron charger or a contact electrifying type charger may be employed. In this case, the charging bias Vg may represent a bias for controlling the surface potential of the photoconductive drum 51.

In the aforementioned illustrative embodiment, the surface potential of the photoconductive drum 51 converges to the same value as the charging bias Vg. Nonetheless, the surface potential of the photoconductive drum 51 may converge to a value different from the charging bias Vg. Further, the potential of the surface of the development roller 53 may not be the same as the value of the development bias Vb. In this case, in the same manner as the predetermined bias, the predetermined potential difference may be a potential difference at which it is anticipated that the "fog" would begin to be observed, and may be any value that satisfies the requirement. It is noted that the "fog" is a situation where toner is transferred onto the unexposed portion (other than the exposed portion) on the photoconductive drum 51. Further, as described above, when each bias to be applied to the corresponding element is not the same as the potential of the surface of the element, the predetermined potential difference and the predetermined bias may not necessarily be identical to each other.

In the aforementioned illustrative embodiment, in S110, the charging bias Vg is reduced to the value more than 0 V. Nonetheless, the charging bias Vg may be reduced to 0 V. Thereby, it would be possible to prevent deterioration of the photoconductive drum 51 more effectively than when the charging bias Vg is reduced to the value more than 0 V.

In the aforementioned illustrative embodiment, the degree of deterioration of the photoconductive drum 51 is evaluated in two levels. Then, when it is determined that the degree of deterioration of the photoconductive drum 51 is large (S107: Yes), the point of time to reduce the charging bias Vg is set later (i.e., the period of time between when the image forming process for the photoconductive drum 51 is completed and when the charging bias Vg is reduced is set longer). Nonetheless, for instance, the degree of deterioration of the photoconductive drum 51 may be evaluated in a plurality of levels. In this case, as the degree of deterioration of the photoconductive drum 51 is larger, the point of time to reduce the charging bias Vg may be set later. Further, when it is determined that the photoconductive drum 51 is deteriorated, the point of time to reduce the charging bias Vg may not necessarily be set later. In this case, instead, the point of time to begin to separate the development roller 53 away from the photoconductive drum 51 may be set earlier. Namely, the period of time between when the image forming process for the photoconductive drum 51 is completed and when the development roller 53 begins to be separated away from the photoconductive drum 51 may be set shorter. Thereby, the period of time between the point of time to reduce the charging bias Vg and the point of time to start separating the development roller 53 away from the photoconductive drum 51 may be shortened. Alternatively, both the point of time to reduce the charging bias Vg and the point of time to start separating the development roller 53 away from the photoconductive drum 51 may be changed. Thereby, the period of time between the point of time to reduce the charging bias Vg and the point of time to start separating the development roller 53 away from the photoconductive drum 51 may be shortened.

In the aforementioned illustrative embodiment, the rotation of the photoconductive drum 51 is stopped before the development roller 53 begins to be separated away from the photoconductive drum 51. Nonetheless, the rotation of the photoconductive drum 51 may not necessarily be stopped before the development roller 53 begins to be separated away from the photoconductive drum 51. If the photoconductive drum 51 is rotating when the development roller 53 begins to be separated away from the photoconductive drum 51, it would provide such an advantageous effect that it is less likely that there arises a necessity for beginning to rotate the photoconductive drum 51.

What is claimed is:

1. An image forming apparatus comprising:

an image forming unit comprising:

a photoconductive body;

a charger configured to charge the photoconductive body; and a development roller; and a controller configured to:

apply a charging bias to the charger during image formation on the photoconductive body, an absolute value of the charging bias being a first absolute value;

apply a development bias to the development roller during the image formation on the photoconductive body;

place the development roller in a development position during the image formation on the photoconductive body;

after the image formation on the photoconductive body, reduce the absolute value of the charging bias to a second absolute value less than the first absolute value and greater than the development bias;

after reducing the absolute value of the charging bias, separate the development roller away from the photoconductive body and place the development roller in a non-development position, the non-development position being farther from the photoconductive body than the development position;

after placing the development roller in the non-development position, stop applying the development bias to the development roller; and as an accumulated number of sheets image-formed by the photoconductive body increases, set shorter a period of time between when reducing the absolute value of the charging bias and when beginning to separate the development roller away from the photoconductive body.

2. The image forming apparatus according to claim 1, wherein the image forming unit comprises a plurality of image forming process units, the plurality of image forming process units comprising a first image forming process unit and a second image forming unit, each image forming process unit comprising the photoconductive body, the charger, and the development roller, and wherein the controller is further configured to:

place the development roller of the first image forming process unit in the non-development position after a lapse of a first period of time from completion of the image formation on the photoconductive bodies of all of the plurality of image forming process units;

place the development roller of the second image forming process unit in the non-development position after a lapse of a second period of time from the completion of the image formation on the photoconductive bodies of all of the plurality of image forming process units, the second period of time being longer than the first period of time;

reduce the absolute value of the charging bias applied to the charger of the first image forming process unit after a lapse of a third period of time from the completion of the image formation on the photoconductive bodies of all of the plurality of image forming process units; and reduce the absolute value of the charging bias applied to the charger of the second image forming process unit after a lapse of a fourth period of time from the completion of the image formation on the photoconductive bodies of all of the plurality of image forming process units, the third period of time being set shorter than the fourth period of time.

3. The image forming apparatus according to claim 1, wherein the controller is further configured to stop rotation of the photoconductive body after reducing the absolute value of the charging bias and before separating the development roller away from the photoconductive body and placing the development roller in the non-development position.

4. The image forming apparatus according to claim 1, further comprising a discharger configured to discharge a surface of the photoconductive body, wherein the controller is further configured to:

control the discharger to discharge the surface of the photoconductive body during the image formation on the photoconductive body; and turn off the discharger before reducing the absolute value of the charging bias.

5. An image forming apparatus comprising:

an image forming unit comprising:

a photoconductive body;

a charger configured to charge the photoconductive body;

a development roller; and a plurality of image forming process units, the plurality of image forming process units comprising a first image forming process unit and a second image forming unit, each image forming process unit comprising the photoconductive body, the charger, and the development roller; and a controller configured to:

apply a charging bias to the charger during image formation on the photoconductive body, an absolute value of the charging bias being a first absolute value;

apply a development bias to the development roller during the image formation on the photoconductive body;

place the development roller in a development position during the image formation on the photoconductive body;

after the image formation on the photoconductive body, reduce the absolute value of the charging bias to a second absolute value less than the first absolute value;

after reducing the absolute value of the charging bias, separate the development roller away from the photoconductive body and place the development roller in a non-development position, the non-development position being farther from the photoconductive body than the development position;

after placing the development roller in the non-development position, stop applying the development bias to the development roller;

place the development roller of the first image forming process unit in the non-development position after a lapse of a first period of time from completion of the image formation on the photoconductive bodies of all of the plurality of image forming process units;

place the development roller of the second image forming process unit in the non-development position after a lapse of a second period of time from the completion of the image formation on the photoconductive bodies of all of the plurality of image forming process units, the second period of time being longer than the first period of time;

reduce the absolute value of the charging bias applied to the charger of the first image forming process unit after a lapse of a third period of time from the completion of the image formation on the photoconductive bodies of all of the plurality of image forming process units; and reduce the absolute value of the charging bias applied to the charger of the second image forming process unit after a lapse of a fourth period of time from the completion of the image formation on the photoconductive bodies of all of the plurality of image forming process units, the third period of time being set shorter than the fourth period of time.

6. The image forming apparatus according to claim 5, wherein the controller is further configured to, as an accumulated number of sheets image-formed by the photoconductive body increases, set shorter a period of time between when reducing the absolute value of the charging bias and when beginning to separate the development roller away from the photoconductive body.

7. The image forming apparatus according to claim 6, wherein the controller is further configured to, as the accumulated number of sheets image-formed by the photoconductive body increases, set shorter the period of time between when reducing the absolute value of the charging bias and when beginning to separate the development roller away from the photoconductive body, by setting longer a period of time between when completing the image formation on the photoconductive body and when reducing the absolute value of the charging bias.

8. The image forming apparatus according to claim 5, wherein the controller is further configured to rotate the photoconductive body when separating the development roller away from the photoconductive body and placing the development roller in the non-development position.

9. The image forming apparatus according to claim 5, wherein the controller is further configured to stop rotation of the photoconductive body after reducing the absolute value of the charging bias and before separating the development roller away from the photoconductive body and placing the development roller in the non-development position.

10. The image forming apparatus according to claim 5, wherein the controller is further configured to apply to the development roller the development bias that is constant during a period of time between when completing the image formation on the photoconductive body and when stopping applying the development bias to the development roller.

11. The image forming apparatus according to claim 5, wherein the second absolute value of the charging bias is zero.

12. The image forming apparatus according to claim 5, further comprising a discharger configured to discharge a surface of the photoconductive body, wherein the controller is further configured to:

control the discharger to discharge the surface of the photoconductive body during the image formation on the photoconductive body; and turn off the discharger before reducing the absolute value of the charging bias.

13. The image forming apparatus according to claim 5, wherein when the development roller is placed in the development position, the development roller is in contact with a surface of the photoconductive body.

14. The image forming apparatus according to claim 5, further comprising a memory storing controller-executable instructions, wherein the controller is further configured to, when executing the controller-executable instructions stored in the memory, perform:

applying the charging bias to the charger during image formation on the photoconductive body;

applying the development bias to the development roller during the image formation on the photoconductive body;

placing the development roller in the development position during the image formation on the photoconductive body;

after the image formation on the photoconductive body, reducing the absolute value of the charging bias;

after reducing the absolute value of the charging bias, separating the development roller away from the photoconductive body and placing the development roller in the non-development position; and after placing the development roller in the non-development position, stopping applying the development bias to the development roller.

15. An image forming apparatus comprising:

an image forming unit comprising:

a photoconductive body;

a charger configured to charge the photoconductive body; and a development roller;

an attracting roller configured to contact the photoconductive body; and a controller configured to:

apply a charging bias to the charger during image formation on the photoconductive body, an absolute value of the charging bias being a first absolute value;

apply a development bias to the development roller during the image formation on the photoconductive body;

place the development roller in a development position during the image formation on the photoconductive body;

after the image formation on the photoconductive body, reduce the absolute value of the charging bias to a second absolute value less than the first absolute value;

after reducing the absolute value of the charging bias, separate the development roller away from the photoconductive body and place the development roller in a non-development position, the non-development position being farther from the photoconductive body than the development position;

after placing the development roller in the non-development position, stop applying the development bias to the development roller;

before placing the development roller in the non-development position, apply to the attracting roller a before-separation bias to cause the attracting roller to electrostatically attract toner on the photoconductive body; and after placing the development roller in the non-development position, control the attracting roller and the charger to electrostatically transfer the toner on the attracting roller onto the photoconductive body, by:

applying to the attracting roller an after-separation bias having a same polarity as the toner electrostatically transferred onto the attracting roller; and applying to the charger the charging bias having a same polarity as the after-separation bias and a third absolute value, the third absolute value being less than an absolute value of the after-separation bias; and after the image formation on the photoconductive body, reduce the absolute value of the charging bias to the second absolute value that is identical to the third absolute value.

16. The image forming apparatus according to claim 15, wherein the controller is further configured to, as an accumulated number of sheets image-formed by the photoconductive body increases, set shorter a period of time between when reducing the absolute value of the charging bias and when beginning to separate the development roller away from the photoconductive body.

17. The image forming apparatus according to claim 15, wherein the image forming unit comprises a plurality of image forming process units, the plurality of image forming process units comprising a first image forming process unit and a second image forming unit, each image forming process unit comprising the photoconductive body, the charger, and the development roller, and wherein the controller is further configured to:

place the development roller of the first image forming process unit in the non-development position after a lapse of a first period of time from completion of the image formation on the photoconductive bodies of all of the plurality of image forming process units;

place the development roller of the second image forming process unit in the non-development position after a lapse of a second period of time from the completion of the image formation on the photoconductive bodies of all of the plurality of image forming process units, the second period of time being longer than the first period of time;

reduce the absolute value of the charging bias applied to the charger of the first image forming process unit after a lapse of a third period of time from the completion of the image formation on the photoconductive bodies of all of the plurality of image forming process units; and reduce the absolute value of the charging bias applied to the charger of the second image forming process unit after a lapse of a fourth period of time from the completion of the image formation on the photoconductive bodies of all of the plurality of image forming process units, the third period of time being set shorter than the fourth period of time.

18. The image forming apparatus according to claim 15, wherein the controller is further configured to stop rotation of the photoconductive body after reducing the absolute value of the charging bias and before separating the development roller away from the photoconductive body and placing the development roller in the non-development position.

19. The image forming apparatus according to claim 15, further comprising a discharger configured to discharge a surface of the photoconductive body, wherein the controller is further configured to:

control the discharger to discharge the surface of the photoconductive body during the image formation on the photoconductive body; and turn off the discharger before reducing the absolute value of the charging bias.

* * * * *